US012790772B2

(12) United States Patent
Pawlik

(10) Patent No.: US 12,790,772 B2
(45) Date of Patent: Nov. 10, 2026

(54) SCREED ARRANGEMENT FOR A ROAD PAVER

(71) Applicant: JOSEPH VOEGELE AG, Ludwigshafen/Rhein (DE)

(72) Inventor: Christian Pawlik, Neustadt (DE)

(73) Assignee: Joseph Voegele AG, Ludwigshafen/Rhein (DE)

( * ) Notice: Subject to any disclaimer, the term of this patent is extended or adjusted under 35 U.S.C. 154(b) by 1012 days.

(21) Appl. No.: 17/902,169

(22) Filed: Sep. 2, 2022

(65) Prior Publication Data

US 2023/0071527 A1 Mar. 9, 2023

(30) Foreign Application Priority Data

Sep. 3, 2021 (EP) ..... 21194687

(51) Int. Cl.
*E01C 19/42* (2006.01)
*E01C 19/48* (2006.01)

(52) U.S. Cl.
CPC ..... *E01C 19/42* (2013.01); *E01C 19/48* (2013.01); *E01C 2301/14* (2013.01); *E01C 2301/16* (2013.01)

(58) Field of Classification Search
CPC ..... E01C 19/42; E01C 19/48; E01C 2301/14; E01C 2301/16
See application file for complete search history.

(56) References Cited

U.S. PATENT DOCUMENTS 4,379,653 A * 4/1983 Brown ..... E01C 19/4853 404/104
5,259,693 A 11/1993 Raymond
6,106,192 A 8/2000 Hargis et al.
(Continued)

FOREIGN PATENT DOCUMENTS

CN 111058258 A 4/2020
CN 218813031 U 4/2023
DE 102019002272 A1 10/2020
(Continued)

OTHER PUBLICATIONS

European Search Report Dated Feb. 2, 2022, Application No. 21194687.6, Applicant Joseph Voegele AG, 6 Pages.
(Continued)

*Primary Examiner* — Tara Schimpf
(74) *Attorney, Agent, or Firm* — Brooks Kushman P.C.

(57) ABSTRACT

The disclosure relates to a screed arrangement for a road paver comprising a base screed, a first extending screed and a second extending screed, the first extending screed and the second extending screed being arranged in front of the base screed in a pulling direction of the screed arrangement and being movable transversely to the pulling direction relative to the base screed, wherein at least one of the two extending screeds comprises a material deflecting member configured to displace paving material transversely to a pulling direction of the screed arrangement when the extending screed is stationary relative to the base screed, wherein the first extending screed comprises the material deflecting member, wherein the second extending screed is positioned further away from the base screed in the pulling direction than the first extending screed.

21 Claims, 4 Drawing Sheets

(56) References Cited

U.S. PATENT DOCUMENTS

| | | | | |
|---|---|---|---|---|
| 8,657,527 | B2 | 2/2014 | Angermann | |
| 2011/0305509 | A1* | 12/2011 | Angermann | ..... E01C 19/4873 404/118 |

FOREIGN PATENT DOCUMENTS

| | | | |
|---|---|---|---|
| EP | 2 395 151 | A1 | 12/2011 |
| EP | 2 201 176 | B1 | 8/2013 |
| JP | 2000192417 | * | 12/1998 |
| JP | 2000192417 | A | 7/2000 |
| WO | 2009036779 | A1 | 3/2009 |

OTHER PUBLICATIONS

Chinese Office Action, CN Application No. 2022110749321, Applicant: Joseph Voegele AG, dated Jun. 13, 2025 (with English machine translation) (18 pages).

Chinese Search Report, CN Application No. 2022110749321, Applicant: Joseph Voegele AG, dated Jun. 11, 2025 (with English machine translation) (6 pages).

* cited by examiner

SCREED ARRANGEMENT FOR A ROAD PAVER

CROSS-REFERENCE TO RELATED APPLICATIONS

This application claims foreign priority benefits under 35 U.S.C. § 119(a)-(d) to European patent application number EP 21194687.6, filed Sep. 3, 2021, which is incorporated by reference in its entirety.

TECHNICAL FIELD

The disclosure relates to a screed arrangement for a road paver.

BACKGROUND

Road pavers for paving concrete or bituminous paving mix usually have a screed arrangement that is towed behind the road paver. This screed arrangement smooths the spread paving mix and pre-compacts it considerably before final compaction takes place, for instance by means of a roller following the road paver. It is particularly advantageous if the screed has a variable length in a direction transverse to direction of pave travel of the road paver in order to be able to achieve different pave widths.

EP 2 201 176 B1 discloses a screed board with telescopic sectors arranged one behind the other, which are firmly connected to fixed sectors.

Generic EP 2 395 151 A1 discloses a screed arrangement with a base screed and two extending screeds arranged in front of the base screed in the direction of pave travel, which can be extended and retracted transverse to the direction of pave travel in a common adjustment plane. Such a screed arrangement is also known among experts as a "front mounted screed". In that the two extending screeds are each directly adjacent to the front of the base screed, a material deflecting member which can be adjusted relative thereto is provided on the base screed and/or on at least one of the extending screeds in order to prevent the paving material from becoming jammed between the two extending screeds when they are moved towards one another and a predetermined distance between the two extending screeds falls below a certain value.

A disadvantage of this screed arrangement, however, is that in the direction transverse to the direction of pave travel, the working widths of the extending screeds are limited to about half the working width of the base screed. Consequently, the maximum pave width cannot exceed twice the working width of the base screed. For road construction with larger pave widths, therefore, additional bolt-on extensions have to be added to this screed arrangement, which in turn is labor- and time-consuming.

SUMMARY

It is an object of the disclosure to provide a screed arrangement for a road paver to eliminate the above disadvantages.

The disclosure relates to a screed arrangement for a road paver having a base screed, a first extending screed and a second extending screed, the first extending screed and the second extending screed being arranged in front of the base screed in a pulling direction of the screed arrangement and being movable transversely to the pulling direction relative to the base screed, wherein at least one of the first and second extending screeds includes a material deflecting member configured to displace paving material toward a central axis (M) to a pulling direction of the screed arrangement when the extending screed is stationary relative to the base screed, the first extending screed comprising the material deflecting member, the second extending screed being positioned further from the base screed in the pulling direction of the screed arrangement. Furthermore, the base screed for the first extending screed comprises a shielding element, or a deflector plate or shielding plate. The shielding element may be understood in the broadest sense as a wall. The shielding element is configured to prevent the paving material lying in front of the base screed from shifting laterally beyond the width of the base screed when the first extending screed is retracted. The pulling direction of the screed arrangement is the direction in which the screed arrangement is pulled by a road paver or its tractor during operation, i.e., it corresponds to the direction of travel of the road paver.

One of the main advantages of the screed arrangement according to the disclosure is the high variability of the pave width. This is because the extending screeds arranged one behind the other in the pulling direction in the disclosure can each have essentially the same working width as the base screed. As a result, the maximum pave width of the screed arrangement according to the disclosure can be about three times the working width of the base screed when the two extending screeds are in the maximum extended position, and this without having to add any additional bolt-on extensions. This speeds up the adjustment of the pave width, especially on site, because there is no need to attach, remove or adjust the bolt-on extensions.

Another advantage of the extending screeds being arranged one behind the other in a staggered manner in the pulling direction is that this arrangement causes very little or even no paving material to be jammed between the two extending screeds because they are not moved toward each other in the same plane of displacement during retraction. Furthermore, the material deflecting member of the first extending screed allows the paving material to be displaced towards a central axis to a pulling direction of the screed arrangement, so that when this extending screed is retracted, no paving material is jammed between the extending screed and the shielding member of the base screed. When the first extending screed is retracted, the shielding element can prevent the paving material lying in front of the base screed from being pushed beyond the width of the base screed onto the subgrade or onto a pavement that has already been pre-compacted by means of the extending screed working in the foremost position.

It is convenient if the screed arrangement has a central axis, the central axis being parallel to the pulling direction, each extending screed having an inner side and an outer side, the inner side being closer to the central axis than the outer side in an extended position of the respective extending screed, the material deflecting member being disposed on the inner side of the extending screed.

Preferably, the base screed and the two extending screeds have substantially the same working width. This, as already indicated above, allows the screed arrangement to achieve considerably larger pave widths compared to a known screed arrangement in which the extending screeds are half the size of the base screed.

It is particularly useful if the shielding element is in the form of a plate attached laterally to the base screed body of the base screed and extending beyond the base screed body in the pulling direction. This allows the first extending screed to be retracted and extended over its complete working width.

Falling out of the paving material transverse to the pulling direction is prevented particularly efficiently if the shielding element is formed to be essentially as high as the first extending screed and/or the shielding element extends in the pulling direction corresponding to a working depth of the first extending screed.

In an advantageous embodiment, the shielding element is formed to be adjustable and/or demountable in the pulling direction relative to the base screed. This allows the shielding element to be adjusted in view of a structural configuration of the material deflecting member. A removable shielding element is advantageous for cleaning and possibly transport purposes.

The shielding element or a part formed thereon can expediently be formed to be pivotable relative to the base screed and/or displaceable transversely to the pulling direction. In this way, the paving material can be moved inwards from an outer area in front of the base screed towards a central axis of the screed arrangement running in the pulling direction.

In an alternative embodiment, the shielding element is formed as part of a sideshift of the base screed. Such a sideshift prevents the paving material from falling out beyond a desired width. In addition to its actual function, it also acts as a shielding element.

It is conceivable that the shielding element is arranged as a plate on a sideshift of the base screed. This plate could be formed to be displaceable or pivotable relative to the sideshift in order to push paving material in the direction of the central axis of the screed arrangement. This would allow paving material to be displaced when the extending screed is retracted in such a way that it is not jammed between the two extending screeds. In this context, it would be conceivable for the two extending screeds to be retracted one after the other, i.e., the one positioned closer to the base screed first and the extending screed positioned in front of it at least temporarily offset.

In a particularly stable embodiment, the shielding element is formed as an integral part of a sideshift of the base screed.

Jamming or adhesion of the installation material can be reduced particularly effectively by allowing the material deflecting member and/or the shielding element to be heated.

It is particularly advantageous for the displacement of paving material if the second extending screed also has a material deflecting member configured for the displacement of paving material. It is advantageous if the first extending screed has a shielding element for the material deflecting member of the second extending screed. The structure described earlier, concerning the shielding element of the base screed and the material deflecting member of the first extending screed, is repeated in this variant, at least in a functional respect. Basically, both the shielding elements and the material deflecting members can be formed in a comparable manner.

A sideshift of the first extending screed, which is disposed on an opposite side of the material deflecting member formed thereon, can act as a shielding element for the material deflecting member formed on the second extending screed.

It would be conceivable to provide a shielding element on the sideshift of the first extending screed that is adjustable, in particular pivotable or displaceable, relative to the sideshift formed thereon, in order to promote displacement of the paving material in the direction of a central axis of the screed arrangement.

The screed arrangement is particularly stable if the material deflecting member is rigidly formed on the respective extending screed/s.

It would be conceivable for the material deflecting member to be adjustable between an inactive position, in which it extends parallel to the pulling direction, and an active position, in which it extends at an angle to the pulling direction. Thus, in the inactive position, the material deflecting member does not affect the paving process. Furthermore, in the inactive position, an additional working width is available for extending the extending screeds. In the active position, the positioning of the material deflecting member at an angle to the pulling direction ensures that the paving mix is displaced towards a central axis of the screed arrangement when the extending screeds are retracted. The deflection of the paving material, i.e., in this case the displacement of the paving material towards the central axis of the screed arrangement, becomes particularly effective when the material deflecting member is set in the active position at an angle of 30° to 55° relative to the pulling direction. The material deflecting members may be pivotable about a hinge. It is also possible for a rear side of the material deflecting members to be coupled to the base screed via a sliding fit, so that the rear side can be displaced along the base screed.

The deflection of paving material is particularly efficient if the material deflecting member is configured in the form of a plow structure. This allows the paving material to be pushed away to the front when the extending screed(s) retract(s).

The deflection of paved material is particularly efficient if the material deflecting member extends at a non-zero angle to the pulling direction in plan view, preferably at an angle of 30° to 60°.

It is particularly expedient if the screed arrangement has a screed operating station on the side of the base screed facing the material deflecting member of the first extending screed. From here, a screed operator can excellently monitor the material deflecting member, in particular its plow function during the retraction of the extending screed.

Finally, the disclosure relates to a road paver having a screed arrangement of the type described above. Such a road paver, in particular the screed arrangement applied thereto, enables fast as well as precise adjustment of the paving width without jamming a head of mix between the base screed and the extending screed. Furthermore, the screed arrangement offers the practical advantage of being quickly and precisely adjustable for leveling purposes, in particular for height and cross slope leveling. This is favored above all by the broadly adjustable screed structure of the screed arrangement according to the disclosure, which is, however, composed of a small number of modules.

BRIEF DESCRIPTION OF THE DRAWINGS

In the following, advantageous embodiments of the disclosure are explained in more detail with reference to a drawing.

Identical components are marked with the same reference signs throughout the Figures.

DETAILED DESCRIPTION

Figure 1:
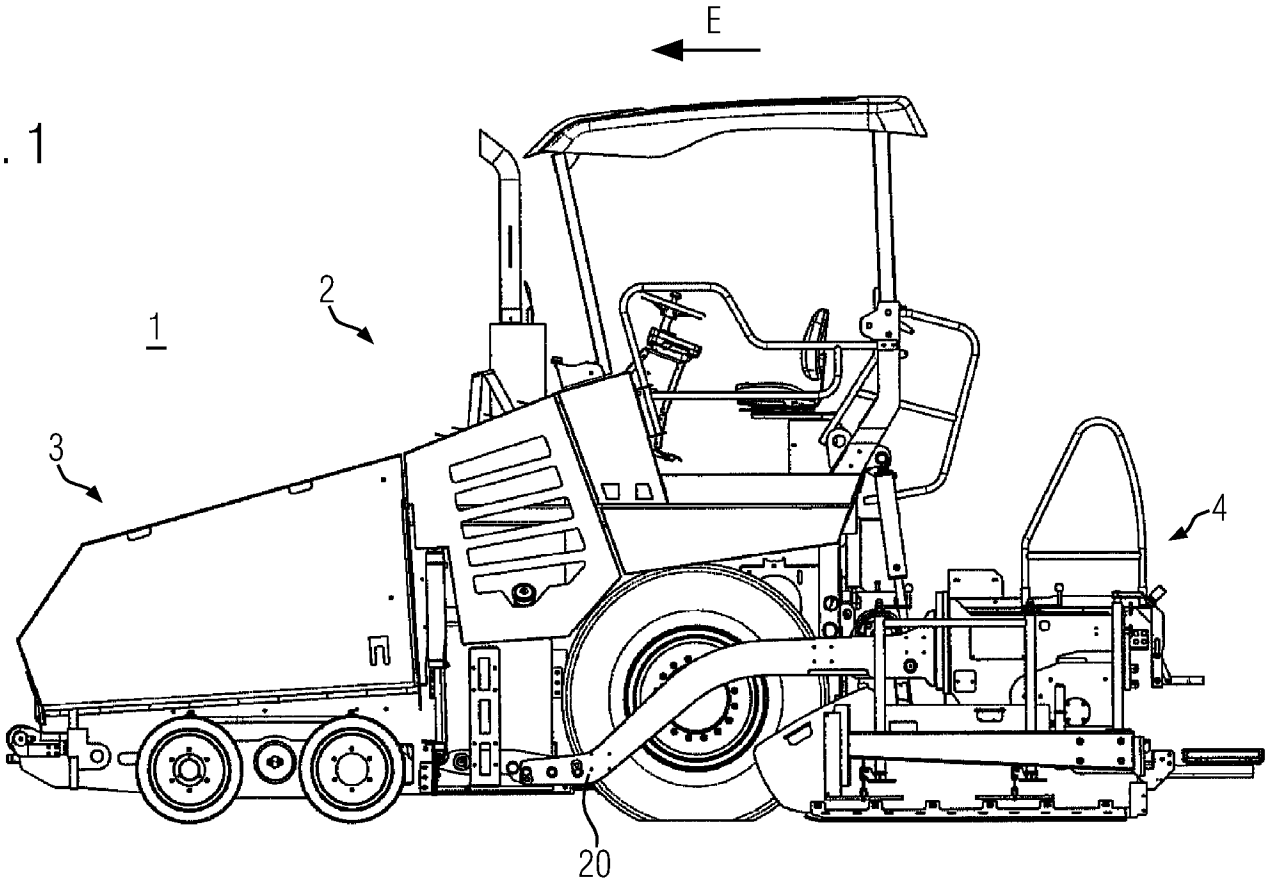
FIG. 1 shows a side view of a road paver.

FIG. 1 shows a side view of a road paver 1, the paving direction of which is indicated by E. The road paver 1 comprises a tractor 2, which has a mix hopper 3 into which asphalt mix can be poured, for example. This mix or paving material can be transported to the rear end of the tractor 2 by a conveyor system (not shown) against the direction of pave travel E of the road paver 1. There, it can be distributed in front of a screed arrangement 4 of the road paver 1 transverse to the direction of pave travel E. The screed arrangement 4 can be mounted on the tractor 2 in a levelable manner by means of support arms 20. The screed arrangement 2 is towed behind the tractor 2 of the road paver 1 in direction of pave travel E.

Between the tractor 2 of the road paver 1 and the screed arrangement 4 towed thereon, there is a transverse spreading device 18 (see FIG. 2), for example two transverse spreading augers, to spread the paving material to be processed over the paving width in front of the screed arrangement 4. The screed arrangement 4 is used in particular for smoothing and/or pre-compacting the mix.

In FIG. 1, the road paver 1 is shown as a wheeled paver. Alternatively, the road paver 1 could have a crawler chassis.

Figure 2:
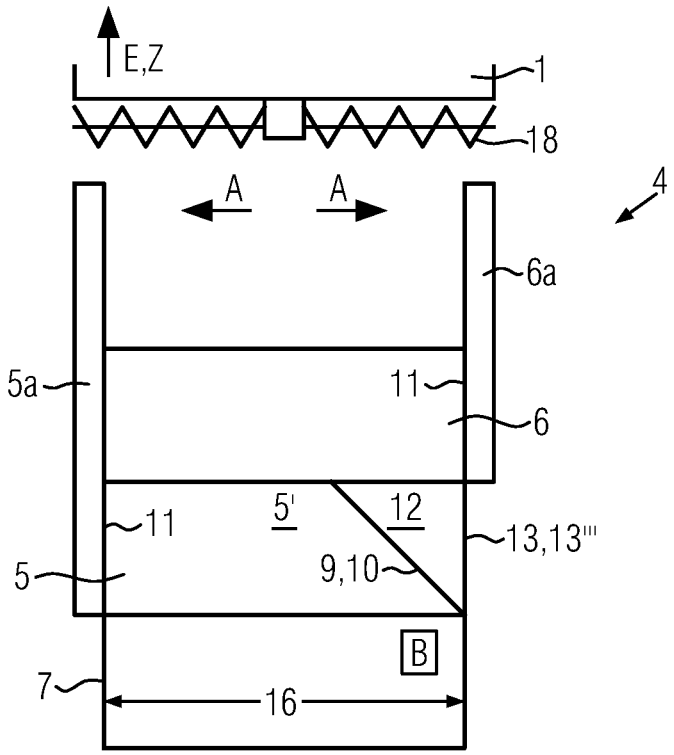
FIG. 2 shows a screed arrangement according to the disclosure in schematic representation.

FIG. 2 shows an embodiment of the screed arrangement 4 according to the disclosure. The screed arrangement 4 is of the "front-mounted screed" type, in which a first extending screed 5 and a second extending screed 6 are arranged in front of a base screed 7 as viewed in a pulling direction Z of the screed arrangement 4. The pulling direction Z of the screed arrangement 4 corresponds to the direction of pave travel E of the road paver 1. The first extending screed 5 is positioned closer to the base screed 7 in the pulling direction Z. The second extending screed 6 is positioned further away from the base screed 7 in the pulling direction Z than the first extending screed 5. Consequently, the first extending screed 5 and the second extending screed 6 are arranged one behind the other in the pulling direction Z, i.e., not in the same plane. The base screed 7 can be a single piece or consist of several parts. Each of the screed parts shown in FIG. 2 has means for smoothing and (pre)compacting paving mix or paving material, for example in the form of screed plates and/or tampers.

FIG. 2 shows a retracted position of the two extending screeds 5, 6. In the direction transverse to the pulling direction Z, both the base screed 7 and the two extending screeds 5, 6 each have essentially the same working width 16. In order to obtain a larger pave width, the extending screeds 5, 6 can be moved in the extending direction A, i.e., transverse to the pulling direction Z, relative to the base screed 7. Suitable drives and guide systems, for example hydraulic drives, guide rails and/or guide rods, are provided for extending and retracting the extending screeds 5, 6.

On an inner side 9 of the first extending screed 5, a material deflecting member 10 is formed, which in FIG. 2 is wedge-shaped and integrally configured with an extending screed body 5' of the first extending screed 5. The base screed 7 has a shielding element 13 for the first extending screed 5. The shielding element 13 is provided laterally on a base screed body 7'. It could, for example, be mounted as a rigid plate 13''', possibly as part of a sideshift formed on the base screed 7. The shielding element 13 forms a wall extending in the pulling direction Z.

The material deflecting member 10 allows the paving mix to be displaced from an area 12 of the screed arrangement 4 when the extending screed 5 retracts. This can prevent paving material from being jammed between the shielding element 13 of the base screed 7 and the immediately preceding extending screed 5. The shielding element 13 prevents paving material from being spread out laterally beyond the width of the base screed 7 when the extending screed 5 is retracted in front of the base screed 7. On an outer side 11 of each of the extending screeds 5, 6, a sideshift **5*a*, 6*a*** is provided, which essentially determines the dimension for the paving width of the new road pavement and prevents the paving mix from spreading beyond a desired width.

Figure 3:
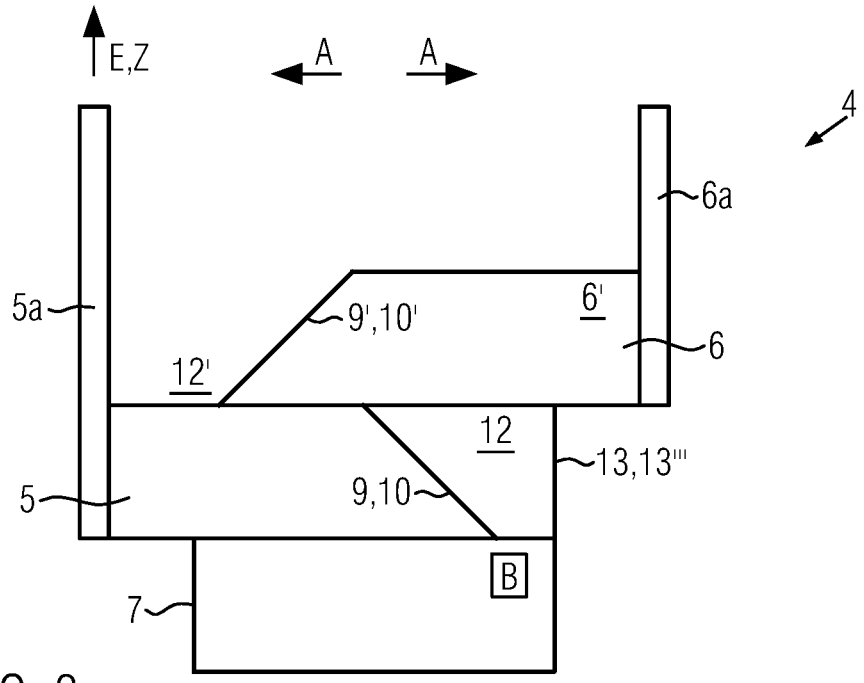
FIG. 3 shows a screed arrangement according to the disclosure when the extending screeds are extended.

FIG. 3 shows the screed arrangement 4 during the extension of the extending screeds 5, 6 in the extending direction A to produce a larger pave width.

In the embodiment shown in FIG. 3, the second extending screed 6 also has a material deflecting member 10' on its inner side 9'. In this embodiment, the material deflecting member 10' is wedge-shaped and integrally formed with an extending screed body 6' of the second extending screed 6. This material deflecting member 10' allows paving mix to be displaced from an area 12' of the screed arrangement 4 when the second extending screed 6 retracts. This can prevent paving material from being jammed between the sideshift **5*a* of the extending screed 5 and the extending screed 6**.

Figure 4:
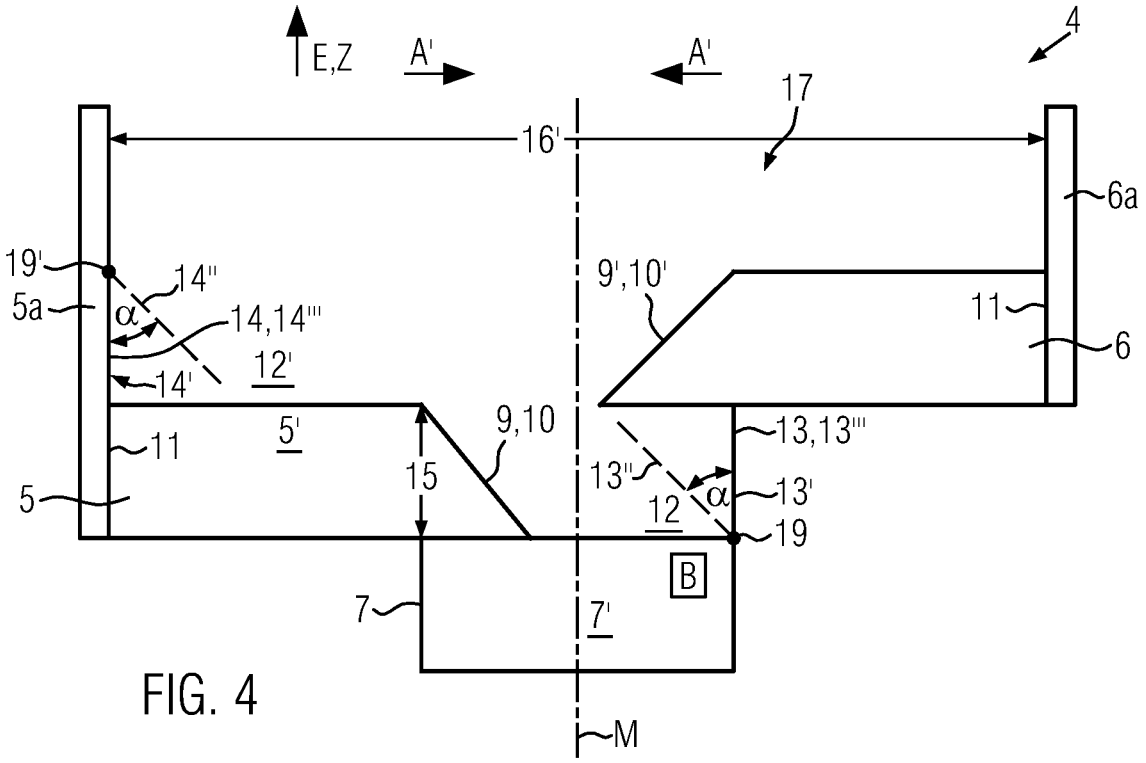
FIG. 4 shows a screed arrangement according to the disclosure in an extended position of the extending screeds.

FIG. 4 shows the screed arrangement 4 in an extended position 17. As shown, each extending screed 5, 6 has a sideshift **5*a*, 6*a* on its outer side 11 and a material deflecting member 10, 10' on its inner side 9. The extended extending screeds 5, 6 allow the total working width 16' to be substantially three times a working width that can be produced by means of the base screed 7** alone.

A variant shown in dashed lines in FIG. 4 provides for the first shielding element 13 to be attached laterally to the base screed 7 so that it can be pivoted by means of a hinge 19. A hydraulic drive (not shown) can be activated for this purpose. In a first position 13', the shielding element 13 is mounted substantially parallel to the pulling direction Z. The shielding element 13 prevents the paving mix or paving material from falling out of the area 12 of the screed arrangement 4 when the screed 5 is retracted, i.e., when the first screed 5 is moved in the retraction direction A'. In a second, position 13" shown in dashed lines, the shielding element 13 is aligned at an angle $\alpha$ of 30° to 55° to the pulling direction Z in order to displace the paving material in the direction of a (virtual) central axis M of the screed arrangement 4. The shielding element 13 is preferably formed as high as the first extending screed 5. The shielding element 13 extends in pulling direction Z corresponding to a working depth 15 of the first extending screed 5.

FIG. 4 also shows that the first extending screed 5 has a shielding element 14 for the second extending screed 6. The shielding element 14 prevents paving material spread out in front of the extending screed 5 from being pushed beyond the width of the extending screed 5 when the extending screed 6 is retracted. The shielding element 14 is provided on the side of the extending screed 5'. It could, for example, be mounted as a rigid plate 14''', possibly provided as part of the sideshift 5*a* formed on the extending screed 5. The shielding element 14 forms a wall extending in the pulling direction Z.

Furthermore, FIG. 4 shows in dashed representation a variant according to which the shielding element 14 is pivotally mounted on the sideshift 5*a* of the first extending screed 5 by means of a hinge 19' relative to the sideshift 5*a* in order to further promote the displacement of the paving material from the area 12' of the screed arrangement 4 during the retraction of the second extending screed 6 in the retraction direction A'. The shielding element 14 can be set between a first position 14' and a second position 14" via a hydraulic actuator (not shown). In the first position 14', the shielding element 14 is substantially parallel to the pulling direction Z. In the second position 14", the shielding element 14 is aligned with an angle α of 30° to 55° with respect to the pulling direction Z to displace the paving material in the direction of the central axis M of the screed arrangement 4 when the screed arrangement 4 is pulled in the pulling direction Z by the road paver.

FIG. 4 shows that the material deflecting member 10 together with the shielding element 13 as well as the material deflecting member 10' together with the shielding element 14 form functional units on the screed arrangement 4 which can prevent jamming of paving material between the shielding element 13 of the base screed 7 and the extending screed 5 as well as between the sideshift 5*a* of the extending screed 5 and the further extending screed 6. As such, these functional units have a mirror-symmetrical structure offset in the pulling direction Z with respect to the central axis M.

Figure 5:
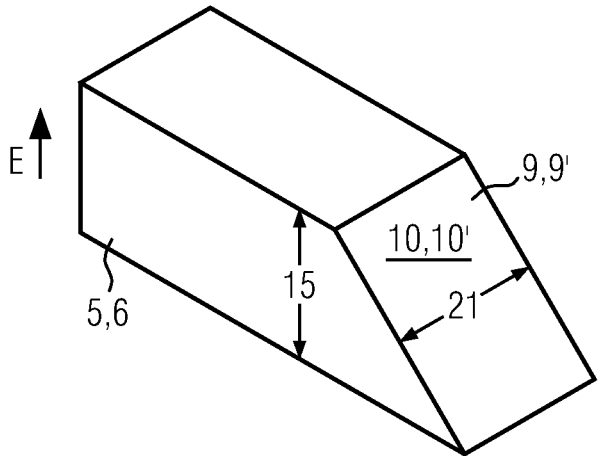
FIG. 5 shows a perspective view of an extending screed in isolated representation.

FIG. 5 shows a perspective view of an extending screed 5, 6, wherein the working depth 15 and a working height 14 of the extending screed 5, 6 are shown.

Figure 6:
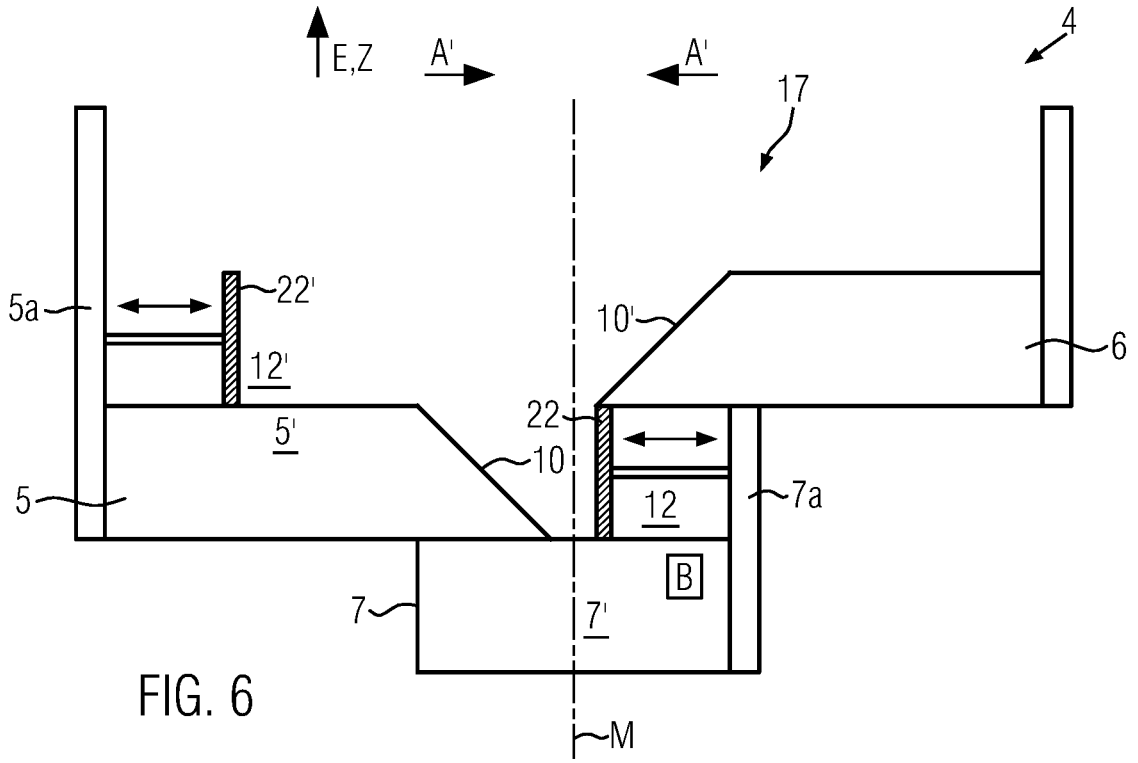
FIG. 6 shows a schematically illustrated variant of the screed arrangement according to the disclosure in an extended position of the extending screeds.

FIG. 6 shows a further embodiment of a screed arrangement 4 in the extended position 17 of the extending screeds 5, 6, wherein each extending screed 5, 6 has a material deflecting member 10, 10', and wherein a shielding element 22, 22' arranged displaceably relative to the respective sideshifts 5*a*, 7*a* is provided on a sideshift 7*a* of the base screed 7 and on the sideshift 5*a* of the first extending screed 5.

Figure 7:
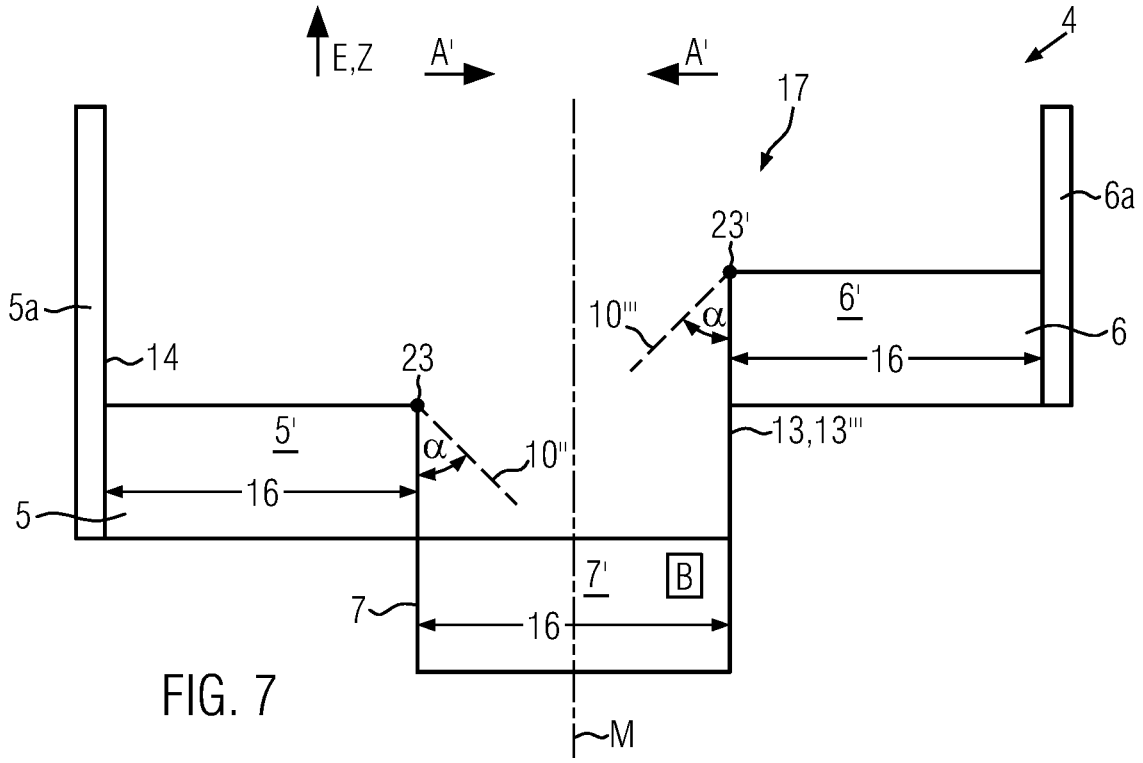
FIG. 7 shows a schematically illustrated further variant of the screed arrangement according to the disclosure in an extended position of the extending screeds.

FIG. 7 shows a further embodiment of a screed arrangement 4 in an extended position 17 of the extending screeds 5, 6, wherein each extending screed 5, 6 has a material deflecting member 10', 10'" pivotable relative to the respective extending screed bodies 5', 6'. The material deflecting members 10", 10'" are pivotable about a hinge 23, 23'. A respective hydraulic drive (not shown) may be provided for this purpose.

In the embodiments shown, the respective material deflecting members 10, 10', 10", 10'" and/or the shielding elements 13, 14, 22, 22' may be formed as a heating plate, in particular as an electric heating plate.

FIGS. 2-4, 6 and 7 show a screed operator station B at the side of the base screed 7. The screed operator station B is positioned facing the first extending screed 5, in particular the area 12.

What is claimed is:

1. A screed arrangement for a road paver comprising a base screed, a first extending screed and a second extending screed, the first extending screed and the second extending screed being arranged in front of the base screed in a pulling direction of the screed arrangement and being movable transversely to the pulling direction relative to the base screed, wherein the first extending screed includes a material deflecting member configured to displace paving material laterally toward a central axis of the screed arrangement when the first extending screed is stationary relative to the base screed while the screed arrangement is pulled in the pulling direction, the second extending screed is positioned further from the base screed than the first extending screed in the pulling direction, the base screed comprises a shielding element positioned laterally with respect to the first extending screed, and the shielding element is configured to prevent displacement of the paving material lying in front of the base screed laterally beyond a width of the base screed during retraction of the first extending screed.

2. The screed arrangement according to claim 1, wherein the central axis is parallel to the pulling direction, each extending screed has an inner side and an outer side, the inner side is closer to the central axis than the outer side in an extended position of the respective extending screed, and the material deflecting member is arranged on the inner side of the first extending screed.

3. The screed arrangement according to claim 2, wherein the material deflecting member slopes in plan view toward the outer side of the first extending screed in the pulling direction.

4. The screed arrangement according to claim 2, wherein the material deflecting member is adjustable, relative to an extending screed body of the first extending screed, to a position in which the material deflecting member slopes in plan view toward the outer side of the first extending screed in the pulling direction.

5. The screed arrangement according to claim 1, wherein the shielding element is present as a plate fastened laterally to a base screed body of the base screed and extending beyond the base screed body in the pulling direction.

6. The screed arrangement according to claim 5, wherein the shielding element is formed substantially at a same height as the first extending screed and/or the shielding element extends in the pulling direction corresponding to a working depth of the first extending screed.

7. The screed arrangement according to claim 1, wherein the shielding element is configured such that it can be adjusted and/or dismantled in the pulling direction relative to the base screed.

8. The screed arrangement according to claim 1, wherein the shielding element is formed as part of a sideshift of the base screed.

9. The screed arrangement according to claim 1, wherein the second extending screed also has a material deflecting member configured for displacing paving material.

10. The screed arrangement according to claim 9, wherein the first extending screed has a shielding element for inhibiting lateral movement of paving material displaced by the material deflecting member of the second extending screed during retraction of the second extending screed.

11. The screed arrangement according to claim 1, wherein the material deflecting member and/or the shielding element can be heated.

12. The screed arrangement according to claim 1, wherein the material deflecting member is rigidly formed on the first extending screed.

13. The screed arrangement according to claim 1, wherein the material deflecting member is adjustable relative to an extending screed body of the first extending screed.

14. The screed arrangement according to claim 13, wherein the material deflecting member is rotatable and/or displaceable relative to the extending screed body of the first extending screed.

15. The screed arrangement according to claim 1, wherein the material deflecting member is in the form of a plow structure.

16. The screed arrangement according to claim 1, wherein the material deflecting member extends in plan view at a non-zero angle to the pulling direction.

17. The screed arrangement according to claim 1, wherein the screed arrangement comprises a screed operating station at the base screed, and facing the first extending screed.

18. A road paver comprising the screed arrangement according to claim 1.

19. A screed arrangement for a road paver comprising a base screed, a first extending screed and a second extending screed, the first extending screed and the second extending screed being arranged in front of the base screed in a pulling direction of the screed arrangement and being movable transversely to the pulling direction relative to the base screed, wherein the first extending screed includes a material deflecting member configured to displace paving material transversely to the pulling direction when the first extending screed is stationary relative to the base screed while the screed arrangement is pulled in the pulling direction, the second extending screed is positioned further from the base screed than the first extending screed in the pulling direction, the base screed comprises a shielding element positioned laterally with respect to the first extending screed, and the shielding element is configured to prevent displacement of the paving material lying in front of the base screed laterally beyond a width of the base screed when the first extending screed is moved from an extended position toward a retracted position.

20. The screed arrangement according to claim 19, wherein the screed arrangement has a central axis that is parallel to the pulling direction, each extending screed has an inner side and an outer side, the inner side is closer to the central axis than the outer side in an extended position of the respective extending screed, the material deflecting member is arranged on the inner side of the first extending screed, and the material deflecting member slopes in plan view toward the outer side of the first extending screed in the pulling direction or the material deflecting member is adjustable to a position in which the material deflecting member slopes in plan view toward the outer side of the first extending screed in the pulling direction.

21. The screed arrangement according to claim 19, wherein the screed arrangement has a central axis that is parallel to the pulling direction, the base screed includes a base screed body, and the shielding element is connected to the base screed body at a location spaced away from the central axis, and wherein the shielding element is configured to extend in the pulling direction.

* * * * *